US007048430B2

(12) United States Patent
Birmingham, Sr. et al.

(10) Patent No.: US 7,048,430 B2
(45) Date of Patent: May 23, 2006

(54) HYDRAULIC CONCRETE MIXER

(76) Inventors: David L. Birmingham, Sr., 3919 E. Nowata Dr., Phoenix, AZ (US) 85044; David L. Birmingham, Jr., 15827 S. 27th Way, Phoenix, AZ (US) 85048

( * ) Notice: Subject to any disclaimer, the term of this patent is extended or adjusted under 35 U.S.C. 154(b) by 172 days.

(21) Appl. No.: 10/806,645

(22) Filed: Mar. 22, 2004

(65) Prior Publication Data

US 2005/0207267 A1 Sep. 22, 2005

(51) Int. Cl.
*B28C 5/26* (2006.01)

(52) U.S. Cl. ..... 366/57; 366/47; 366/61

(58) Field of Classification Search ..... 366/44, 366/45, 47, 57–59, 61, 227, 228
See application file for complete search history.

(56) References Cited

U.S. PATENT DOCUMENTS

RE19,085 E * 2/1934 Jaeger ..... 366/44
2,563,336 A * 8/1951 Jaeger ..... 366/45
3,080,152 A * 3/1963 Lendved ..... 366/44
5,190,372 A * 3/1993 Kasberger ..... 366/45

OTHER PUBLICATIONS

The Ultimate Low Maintenance Mortar/Plaster Mixer (Brochure); Macalite Equipment, Inc., Phoenix, AZ 85040, 1996.
The Ultimate Low Maintenance Mortar/Plaster and Concrete Mixers (Brochure); Macalite Products Corp., Phoenix, AZ 85040, 1981.

* cited by examiner

*Primary Examiner*—David Sorkin
(74) *Attorney, Agent, or Firm*—Kenneth A. Nelson; Allan W. Watts; Bryan Cave LLP

(57) ABSTRACT

A hydraulic concrete mixer includes a drum (110) having a mixing blade (120) attached to an interior thereof, a frame (130) supporting the drum, an engine (140) mounted on the frame, and a drive train (150) extending through at least a portion of the drum. The drive train includes: a hydraulic motor (210); a first rigid plate (220) between the hydraulic motor and the drum; a second rigid plate (230) inside the drum and coupled to the first rigid plate such that a portion of the drum is held between and in fixed relationship to the first rigid plate and the second rigid plate; a first shaft (240) inside the drum and adjacent to the second rigid plate; a second shaft (250) adjacent to the first shaft; and a mounting plate (260) coupled to the second shaft.

17 Claims, 5 Drawing Sheets

HYDRAULIC CONCRETE MIXER

FIELD OF THE INVENTION

This invention relates generally to mixing equipment, and relates more particularly to concrete mixers.

BACKGROUND OF THE INVENTION

Although concrete and mortar are sometimes thought of as being interchangeable, a person of ordinary skill in the relevant art will recognize that there are various differences between the two materials. As an example, mortar is best mixed in a mortar mixer, characterized by a stationary drum having blades that turn inside the drum, rather than in a concrete mixer, which is characterized by a turning drum and stationary blades. A concrete mixer, for example, cannot give mortar the same thorough consistency that a mortar mixer can. Similarly, a mortar mixer cannot mix concrete as well as a concrete mixer can.

The hydraulic mortar mixer is becoming increasingly popular in the mortar industry because of the various advantages it offers over other kinds of mortar mixers. For example, compared to other mortar mixers, hydraulic mortar mixers typically have fewer parts to wear out, and thus are more efficient and reliable, can handle larger loads, are easier to maintain, and can clear jams much more easily. A hydraulic concrete mixer would offer the same advantages to the concrete industry, yet the existing concrete mixers are direct drive mixers that are incompatible with hydraulic apparatus. Accordingly, there exists a need for a concrete mixer having a drive train that is compatible with a hydraulic motor.

BRIEF DESCRIPTION OF THE DRAWINGS

The invention will be better understood from a reading of the following detailed description, taken in conjunction with the accompanying figures in the drawings in which.

Figure 1:
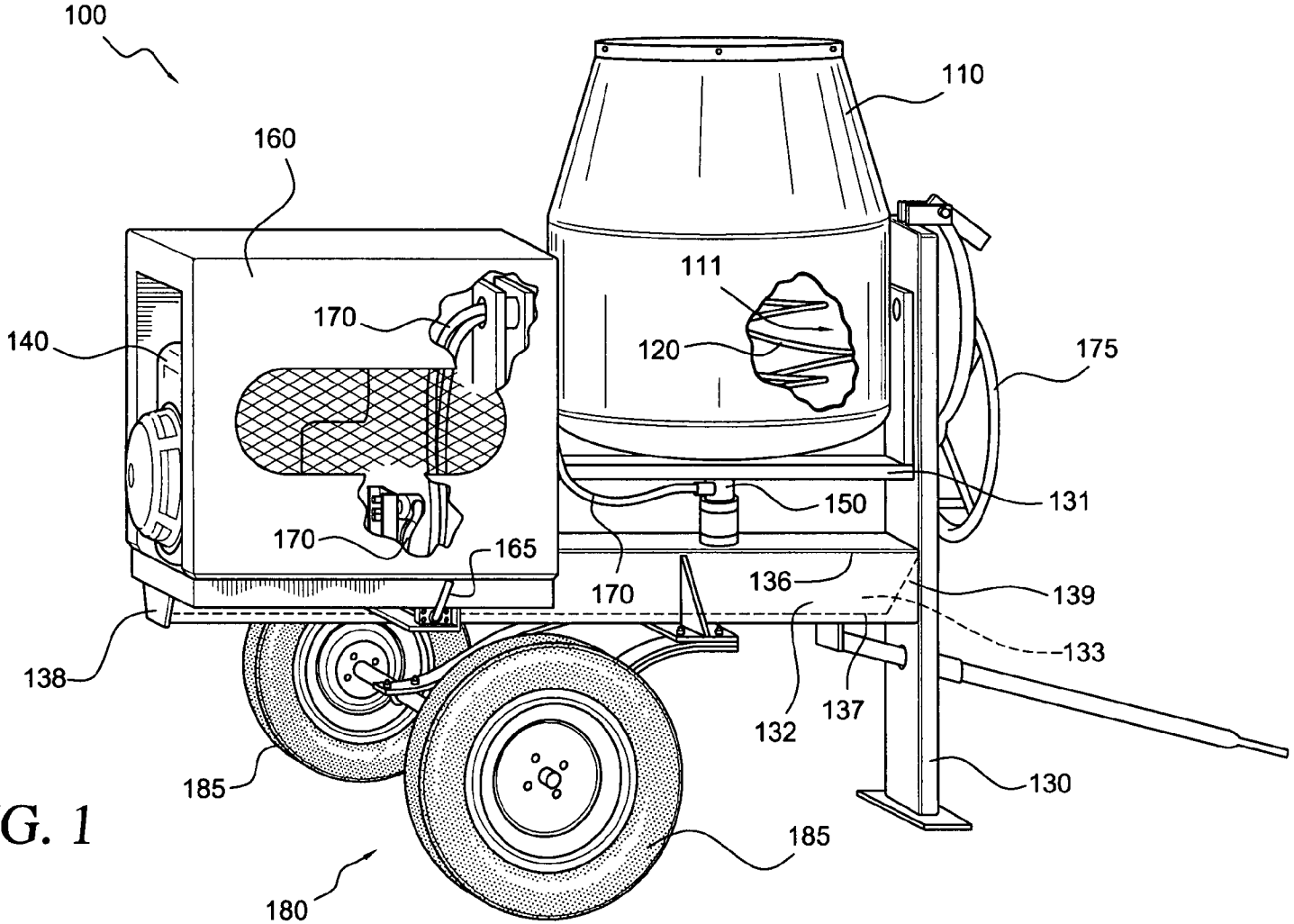
FIG. 1 is a partially cut-away view of a portion of a hydraulic concrete mixer according to an embodiment of the invention.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "comprise," "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein. The term "coupled," as used herein, is defined as directly or indirectly connected in an electrical, mechanical, or other manner.

DETAILED DESCRIPTION OF THE DRAWINGS

In one embodiment of the invention, a hydraulic concrete mixer comprises a drum having a mixing blade attached to an interior thereof, a frame supporting the drum, an engine mounted on the frame, and a drive train extending through at least a portion of the drum. The drive train comprises: a hydraulic motor; a first rigid plate between the hydraulic motor and the drum; a second rigid plate inside the drum and coupled to the first rigid plate such that a portion of the drum is held between and in fixed relationship to the first rigid plate and the second rigid plate; a first shaft inside the drum and adjacent to the second rigid plate; a second shaft adjacent to the first shaft; and a mounting plate coupled to the second shaft.

FIG. 1 is a partially cut-away view of a hydraulic concrete mixer 100 according to an embodiment of the invention. As illustrated in FIG. 1, hydraulic concrete mixer 100 comprises a drum 110 having a mixing blade 120 attached to an interior 111 of drum 110, a frame 130 supporting drum 110, an engine 140 mounted on frame 130, and a drive train 150 extending through drum 110. In one embodiment, engine 140 is a gasoline-powered engine. In other embodiments, engine 140 may be a diesel engine or an electric engine.

Frame 130 comprises a mounting bar 131 and further comprises a fluid reservoir 132 capable of containing hydraulic fluid. In the embodiment illustrated in FIG. 1, fluid reservoir 132 contains a baffle 133. Baffle 133 is angled between an upper edge 136 of fluid reservoir 132 and a lower edge 137 diagonally opposite upper edge 136. As is known in the art, if the hydraulic fluid within fluid reservoir 132 were not cooled, the hydraulic fluid would get hot enough to melt or otherwise impair the integrity of frame 130. Baffle 133 cools the hydraulic fluid in fluid reservoir 132 by forcing the hydraulic fluid to move along a path stretching between an end 138 of fluid reservoir 132 and an end 139 opposite end 138. As an example, baffle 133 cools the hydraulic fluid to between approximately 70 and 80 degrees Celsius (approximately 160 and 170 degrees Fahrenheit), which temperature range is at or near an ideal operating temperature range for hydraulic fluid.

As an example, drum 110 can be constructed of plastic, fiberglass, or a similar material. Drums constructed of the foregoing materials are lighter, less expensive, and easier to clean than are drums constructed of metal. However, plastic, fiberglass, and similar drums, without support, are not sturdy enough to withstand the forces to which they are subjected during hydraulic rotation. Such support for drum 110 of hydraulic concrete mixer 100 is supplied by portions of drive train 150. Because only a portion of drive train 150 is visible in FIG. 1, a further description of drive train 150 will be deferred to the discussion of FIG. 2, below.

Referring still to FIG. 1, hydraulic concrete mixer 100 further comprises an engine cover 160, a hydraulic valve 165, a plurality of hoses 170, a tilt wheel 175, and a wheel assembly 180 including wheels 185. Wheels 185 and wheel assembly 180 are capable of bearing the weight of hydraulic concrete mixer 100 such that hydraulic concrete mixer 100 may be transported from one location to another. As an example, hydraulic concrete mixer 100 may be towed behind a vehicle. Hydraulic valve 165 and plurality of hoses 170, along with frame 130 and engine 140, are further described in connection with FIG. 4, below.

Figure 2:
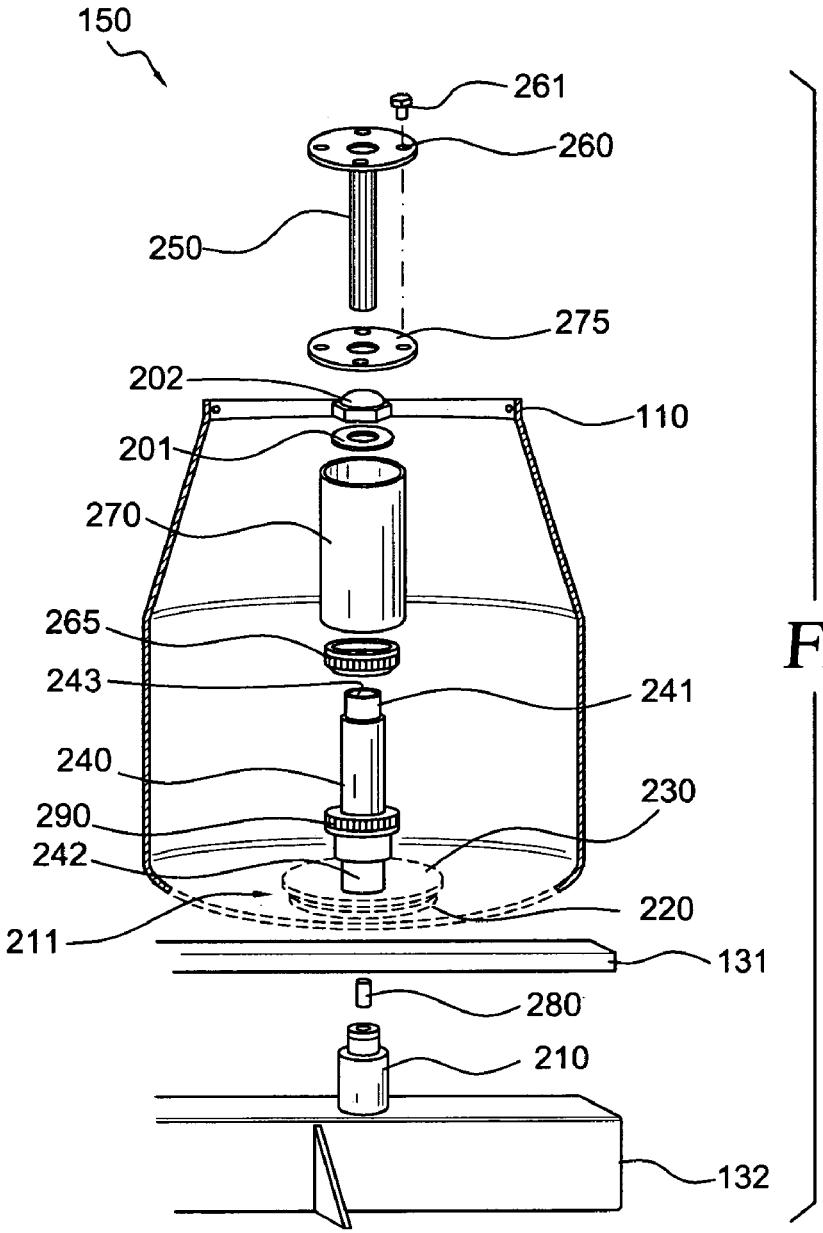
FIG. 2. is an exploded view of a drive train of a hydraulic concrete mixer according to an embodiment of the invention.

FIG. 2 is an exploded view of drive train 150 according to an embodiment of the invention. As illustrated in FIG. 2, drive train 150 comprises a hydraulic motor 210 outside and adjacent to drum 110, a rigid plate 220 between hydraulic motor 210 and drum 110, and a rigid plate 230 inside drum 110 and coupled to rigid plate 220 such that a portion 211 of drum 110 is held between and in fixed relationship to rigid plate 220 and rigid plate 230.

As mentioned above, drum 110 may be formed from plastic, fiberglass, or a similar material so as to be, among other possible advantages, lightweight, inexpensive, and easy to clean. As also mentioned above, drums constructed of such materials require support in order to be able to withstand the forces to which they are subjected during hydraulic rotation. In the embodiment illustrated in FIG. 2, rigid plates 220 and 230 provide such support for drum 110 by holding portion 211 between each other as described.

In one embodiment, rigid plate 220 and rigid plate 230 are bolted to each other such that rigid plate 220 and rigid plate 230 maintain a fixed relationship to each other. In the same or another embodiment, rigid plates 220 and 230 are steel plates having a diameter of approximately 30 centimeters (approximately 12 inches) and a thickness between one and two centimeters (approximately half an inch).

As further illustrated in FIG. 2, drive train 150 further comprises a shaft 240 inside drum 110 and adjacent to rigid plate 230, a shaft 250 adjacent to, and, in at least one embodiment, at least partially inside, shaft 240, and a mounting plate 260 coupled to shaft 250. In addition to the type depicted in FIG. 2, mounting plate 260 can be a structure of any type that is capable of or useful for attaching shaft 250 to another portion of drive train 150. Shaft 240 is attached to mounting bar 131 such that shaft 240 does not rotate. Shaft 240 has an end 241, has an end 242 substantially opposite end 241, and defines a passageway 243 extending between end 241 and end 242. As an example, shaft 240 may be a pinion shaft, and may be welded to mounting bar 131, and shaft 250 may be a spline shaft, a key shaft, or other drive shaft or the like.

Drive train 150, in the embodiment illustrated in FIG. 2, still further comprises a bearing 265 on shaft 240, a sleeve 270 over bearing 265 and over at least a portion of shaft 240, a flange or mounting plate 275 coupled to mounting plate 260, and a coupler 280 coupling together shaft 250 and hydraulic motor 210. As an example, if shaft 250 is a spline shaft, coupler 280 can be provided with grooves or splines that are complementary to the splines in shaft 250, so as to permit a coupling between shaft 250 and hydraulic motor 210 such that hydraulic motor 210 can turn shaft 250, and thus turn drum 110. A washer 201 and a nut 202 function to hold drive train 150 together. Rigid plate 230 has an opening substantially in the center thereof that is sized to admit the passage of shaft 240, bearings 265 and 290, sleeve 270, and mounting plate 275 therethrough. Rigid plate 230 may also be referred to as a flange, a compression ring, a pressure plate, or the like.

As an example, mounting plate 275 and mounting plate 260 can be bolted together using bolts 261. In one embodiment, sleeve 270 is welded to rigid plate 220. In a particular embodiment, mounting plate 275 is welded or otherwise attached to sleeve 270, and sleeve 270 is welded or otherwise attached to rigid plate 220, such that mounting plate 275, sleeve 270, and rigid plate 220 form a single component of drive train 150.

Drive train 150 still further comprises a bearing 290 inside sleeve 270. As an example, bearings 265 and 290 can be devices capable of or adapted to support, guide, and/or reduce friction associated with one or more components of hydraulic concrete mixer 100. As a particular example, bearings 265 and 290 can be tapered roller bearings having taper angles that allow bearings 265 and 290 to handle a combination of radial and thrust loads.

In operation, hydraulic motor 210 turns coupler 280, which turns shaft 250 and mounting plate 260. The rotation of mounting plate 260 causes the rotation of rigid plate 220, sleeve 270, and mounting plate 275, which in turn causes the rotation of rigid plate 230. Because drum 110 is mounted between rigid plates 220 and 230 in such a way that drum 110 remains in fixed relationship to rigid plates 220 and 230, drum 110 rotates along with rigid plates 220 and 230. Mixing blade 120, along with additional mixing blades as described below, all of which are fixed to drum 110, rotates with drum 110, thus providing for the mixing of concrete within drum 110.

Figure 3:
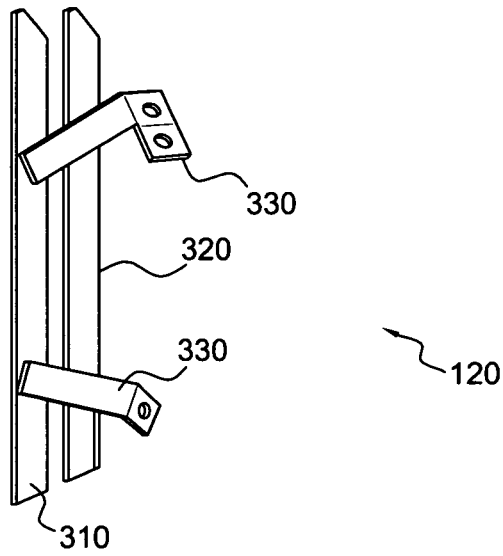
FIG. 3 is an elevational view of a mixing blade of a hydraulic concrete mixer according to an embodiment of the invention.

FIG. 3 is an elevational view of mixing blade 120 according to an embodiment of the invention. As illustrated in FIG. 3, mixing blade 120 comprises a bar 310, a bar 320 adjacent to bar 310, and a mounting brace 330 attaching bar 310 and bar 320 to drum 110 (FIG. 1). In one embodiment, hydraulic concrete mixer 100 comprises, in addition to mixing blade 120, a second and a third mixing blade attached to the interior of drum 110. In that embodiment, mixing blade 120, the second mixing blade, and the third mixing blade may be spaced apart such that they are substantially equidistant from each other. Spacing the mixing blades equidistantly in this fashion helps balance hydraulic concrete mixer 100, and also provides a more even, consistent concrete mix than would a mixer having mixing blades in some other configuration.

Figure 4:
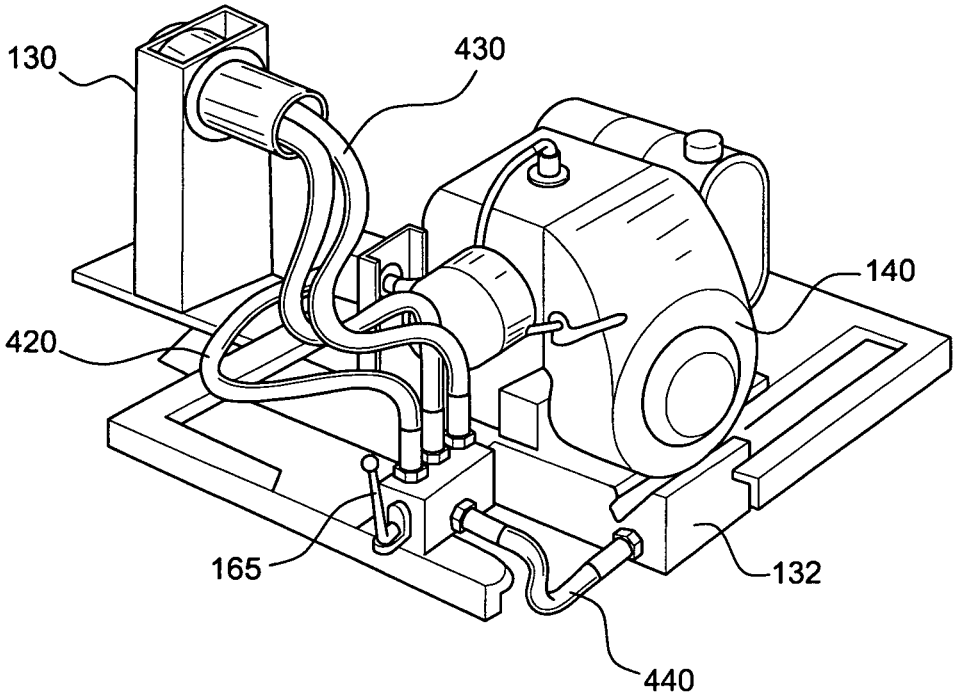
FIG. 4 is a perspective view of a portion of a hydraulic concrete mixer according to an embodiment of the invention.

FIG. 4 is a perspective view of a portion of hydraulic concrete mixer 100 according to an embodiment of the invention. As illustrated in FIG. 4, hydraulic concrete mixer 100 comprises hydraulic valve 165, and further comprises a power hose 420 connecting fluid reservoir 132 to hydraulic valve 165, a hydraulic hose 430 connecting hydraulic valve 165 to hydraulic motor 210 (FIG. 2), and a return hose 440 connecting hydraulic valve 165 to fluid reservoir 132. Hydraulic valve 165 may be used to select the direction of rotation for drum 110 (FIG. 1). In a non-illustrated embodiment, hydraulic concrete mixer 100 may further comprise a filter between return hose 440 and fluid reservoir 132. As an example, placing hydraulic valve 165 in a first position makes drum 110 rotate as described above, and placing hydraulic valve 165 in a second position puts hydraulic concrete mixer 100 in an "idle" setting where drum 110 does not rotate.

Figure 5:
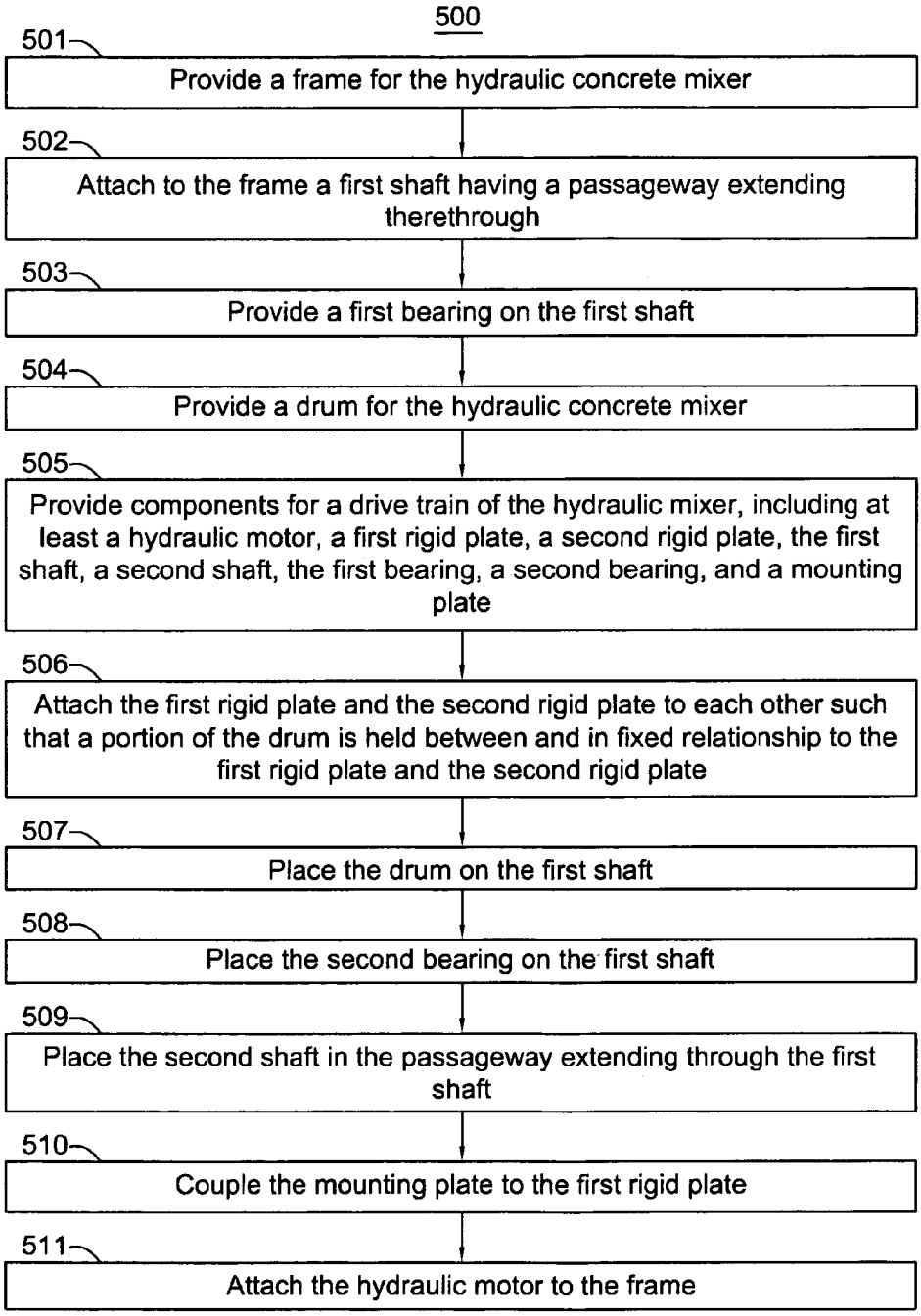
FIG. 5 is a flowchart illustrating a method of manufacturing a hydraulic concrete mixer according to an embodiment of the invention.

FIG. 5 is a flowchart illustrating a method 500 of manufacturing a hydraulic concrete mixer according to an embodiment of the invention. A step 501 of method 500 is to provide a frame for the hydraulic concrete mixer. As an example, the frame can be similar to frame 130, first shown in FIG. 1.

A step 502 of method 500 is to attach to the frame a first shaft having a passageway extending therethrough. As an example, the first shaft can be similar to shaft 240, first shown in FIG. 2. As another example, the first shaft can be welded to the frame.

A step 503 of method 500 is to provide a first bearing on the first shaft. As an example, the first bearing can be similar to bearing 290, first shown in FIG. 2. In one embodiment, step 503 can comprise placing the first bearing on the first shaft after attaching the first shaft to the frame as in step 502. In another embodiment, step 503 can comprise obtaining the first shaft with the first bearing already placed thereon, or can comprise placing the first bearing on the first shaft before attaching the first shaft to the frame. In this other embodiment, step 503 would be performed before step 502.

A step 504 of method 500 is to provide a drum for the hydraulic concrete mixer. As an example, the drum can be similar to drum 110, first shown in FIG. 1.

A step 505 of method 500 is to provide components for a drive train of the hydraulic mixer, including at least a hydraulic motor, a first rigid plate, a second rigid plate, the first shaft, a second shaft, the first bearing, a second bearing, and a mounting plate. As an example, the hydraulic motor, the first rigid plate, the second rigid plate, the first shaft, the second shaft, the first bearing, the second bearing, and the mounting plate can be similar to, respectively, hydraulic motor 210, rigid plate 220, rigid plate 230, shaft 240, shaft 250, bearing 290, bearing 265, and mounting plate 260, all of which were first shown in FIG. 2.

A step 506 of method 500 is to attach the first rigid plate and the second rigid plate to each other such that a portion of the drum is held between and in fixed relationship to the first rigid plate and the second rigid plate. As an example, the portion of the drum held between and in fixed relationship to the first and second rigid plates can be similar to portion 211 of drum 110, which portion is first shown in FIG. 2.

A step 507 of method 500 is to place the drum on the first shaft. As an example, step 507 can comprise passing the first and second rigid plates, which were attached to the drum in step 506, over at least a portion of the first shaft until the drum is close to or adjacent to the frame.

A step 508 of method 500 is to place the second bearing on the first shaft.

A step 509 of method 500 is to place the second shaft in the passageway extending through the first shaft.

A step 510 of method 500 is to couple the mounting plate to the first rigid plate. In one embodiment, the coupling performed in step 510 can be accomplished via a coupling between the mounting plate and a second mounting plate that is attached to a sleeve that is in turn attached to the first rigid plate. As an example, the second mounting plate can be similar to mounting plate 275, and the sleeve can be similar to sleeve 270, both of which were first shown in FIG. 2. In this embodiment, the second mounting plate, the sleeve, and the first rigid plate can be formed into a single component of the drive train of the hydraulic concrete mixer, as was first described above, and the coupling of the mounting plate to the second mounting plate accomplishes the coupling of the mounting plate to the first rigid plate, also as described above.

A step 511 of method 500 is to attach the hydraulic motor to the frame. As an example, the hydraulic motor can be welded to the frame.

It will be recognized by one of ordinary skill in the art that the steps of method 500 discussed above can in certain embodiments be performed in an order other than that presented above. As an example, in one embodiment step 508 can be performed before step 507. In the same or another embodiment, step 509 can be performed before step 507 and/or step 508. In the same or another embodiment, step 511 can be performed before one or more of steps 502, 503, 504, 506, 507, 508, and 509. Further examples of a different order for the steps of method 500 may also be possible.

Figure 6:
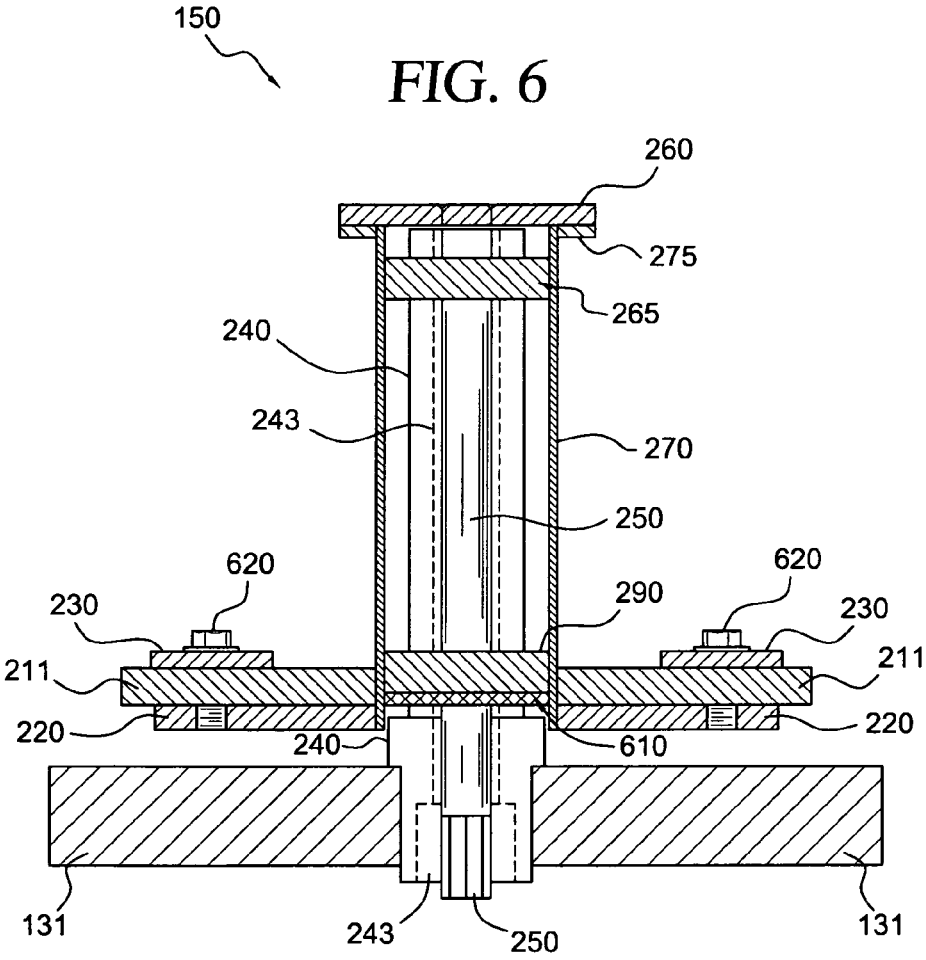
FIG. 6 is a cross-sectional view of a portion of a drive train for a hydraulic concrete mixer according to an embodiment of the invention.

FIG. 6 is a cross-sectional view of a portion of drive train 150 in an assembled form according to an embodiment of the invention. As illustrated in FIG. 6, and with reference also to FIG. 2, shaft 240 is welded or otherwise attached to mounting bar 131, and mounting plate 275, sleeve 270, and rigid plate 220 are welded together, or otherwise attached to each other, to form a single component, as described above. Bearings 265 and 290 are on shaft 240. Rigid plates 220 and 230 are on opposite sides of drum 110 such that portion 211 of drum 110 (FIG. 2) is between rigid plates 220 and 230, and rigid plates 220 and 230 are bolted or otherwise attached to each other, using bolts 620, for example, such that portion 211 is held between and in fixed relationship to rigid plates 220 and 230. Drum 110 is on shaft 240. Sleeve 270 covers bearings 265 and 290 as well as shaft 240. Shaft 250 is coupled to mounting plate 260, extends through passageway 243 of shaft 240, and is coupled to hydraulic motor 210 (FIG. 2) via coupler 280 (FIG. 2). Mounting plate 260 is bolted or otherwise attached to mounting plate 275. Drive train 150 can further comprise a seal 610 near bearing 290. In the embodiment illustrated in FIG. 6, rigid plate 230 is shown as being thinner than rigid plate 220. In another embodiment, as described above, rigid plates 220 and 230 can have the same or substantially similar thicknesses.

Although the invention has been described with reference to specific embodiments, it will be understood by those skilled in the art that various changes may be made without departing from the spirit or scope of the invention. Various examples of such changes have been given in the foregoing description. Accordingly, the disclosure of embodiments of the invention is intended to be illustrative of the scope of the invention and is not intended to be limiting. It is intended that the scope of the invention shall be limited only to the extent required by the appended claims. For example, to one of ordinary skill in the art, it will be readily apparent that the hydraulic concrete mixer discussed herein may be implemented in a variety of embodiments, and that the foregoing discussion of certain of these embodiments does not necessarily represent a complete description of all possible embodiments. Rather, the detailed description of the drawings, and the drawings themselves, disclose at least one preferred embodiment of the invention, and may disclose alternative embodiments of the invention.

All elements claimed in any particular claim are essential to the invention claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A hydraulic concrete mixer comprising:
a drum having a mixing blade attached to an interior thereof;
a frame supporting the drum;
an engine mounted on the frame; and
a drive train extending through at least a portion of the drum, the drive train comprising:
a hydraulic motor;
a first rigid plate between the hydraulic motor and the drum;
a second rigid plate inside the drum and coupled to the first rigid plate such that a portion of the drum is held between and in fixed relationship to the first rigid plate and the second rigid plate;
a first shaft at least partially inside the drum and adjacent to the second rigid plate;
a second shaft adjacent to the first shaft; and
a mounting plate coupled to the second shaft,
wherein:
the first shaft comprises:
a first end; and
a second end substantially opposite the first end; and
the first shaft defines a passageway extending between the first end and the second end.

2. The hydraulic concrete mixer of claim 1 wherein:
the frame comprises a mounting bar; and
the first shaft is attached to the mounting bar such that the first shaft does not rotate.

3. The hydraulic concrete mixer of claim 1 wherein:
the first rigid plate and the second rigid plate are bolted to each other such that the first rigid plate and the second rigid plate maintain a fixed relationship to each other.

4. The hydraulic concrete mixer of claim 3 wherein:
the first rigid plate and the second rigid plate are formed from steel.

5. The hydraulic concrete mixer of claim 4 wherein:
the first rigid plate and the second rigid plate have a thickness between approximately one and two centimeters.

6. The hydraulic concrete mixer of claim 1 further comprising:
a bearing on the first shaft;
a sleeve over the bearing and over at least a portion of the first shaft;
a second mounting plate coupled to the mounting plate; and
a coupler coupling the second shaft to the hydraulic motor.

7. The hydraulic concrete mixer of claim 6 further comprising:
a second bearing inside the sleeve.

8. The hydraulic concrete mixer of claim 1 further comprising:
a second mixing blade attached to the interior of the drum; and
a third mixing blade attached to the interior of the drum, wherein:
the mixing blade, the second mixing blade, and the third mixing blade are spaced apart such that they are substantially equidistant from each other.

9. The hydraulic concrete mixer of claim 8 wherein:
the mixing blade, the second mixing blade, and the third mixing blade comprise:
a first bar;
a second bar adjacent to the first bar; and
a mounting brace attaching the first bar and the second bar to the drum.

10. The hydraulic concrete mixer of claim 1 wherein:
the frame comprises:
a mounting bar; and
a fluid reservoir capable of containing hydraulic fluid, wherein:
the first shaft is attached to the mounting bar such that the first shaft does not rotate.

11. The hydraulic concrete mixer of claim 10 further comprising:
a hydraulic valve;
a power hose connecting the fluid reservoir to the hydraulic valve;
a hydraulic hose connecting the hydraulic valve to the hydraulic motor; and
a return hose connecting the hydraulic valve to the fluid reservoir.

12. The hydraulic concrete mixer of claim 11 further comprising:
a filter between the return hose and the fluid reservoir.

13. The hydraulic concrete mixer of claim 10 wherein:
the fluid reservoir further contains a baffle.

14. The hydraulic concrete mixer of claim 13 wherein:
the baffle is angled between an upper edge of the fluid reservoir and a lower edge of the fluid reservoir opposite the upper edge.

15. The hydraulic concrete mixer of claim 1 wherein:
the drum comprises a plastic material.

16. The hydraulic concrete mixer of claim 1 wherein:
the engine is a gasoline-powered engine.

17. The hydraulic concrete mixer of claim 1 wherein:
the frame is attached to at least one wheel capable of bearing the weight of the hydraulic concrete mixer.

* * * * *